United States Patent [19]

Hawks et al.

[11] 4,003,102

[45] Jan. 18, 1977

[54] DOOR AND WINDOW CLOSER

[75] Inventors: Nathaniel L. Hawks; John R. Shively, both of Albany, Calif.

[73] Assignee: Elmer E. Jones, Oakland, Calif.

[22] Filed: Aug. 7, 1975

[21] Appl. No.: 602,731

[52] U.S. Cl. ..... 16/72; 16/81; 16/DIG. 21; 49/404

[51] Int. Cl.[2] ..... E05F 1/02; E05F 1/08

[58] Field of Search ..... 16/49, 66, 67, 63, 64, 16/65, 69, 70, 71, 78, 79, 81, DIG. 8, DIG. 9, DIG. 10, DIG. 17, DIG. 21; 49/137, 404; 185/4, 27

[56] References Cited

UNITED STATES PATENTS

| | | | |
|---|---|---|---|
| 1,871,030 | 8/1932 | Bommer | 16/DIG. 21 |
| 2,735,675 | 2/1956 | Lindsey | 16/DIG. 8 |
| 3,334,444 | 8/1967 | Hargrove | 16/81 X |
| 3,389,422 | 6/1968 | Glenn | 16/78 |

*Primary Examiner*—Werner H. Schroeder
*Assistant Examiner*—Moshe I. Cohen
*Attorney, Agent, or Firm*—James R. Cypher

[57] ABSTRACT

A spring or gravity motor having an override mechanism for a movable window or door including a pneumatic cylinder, a piston, a check valve admitting air to the cylinder, an override valve permitting pressure dumping of the air in the cylinder during movement of the door or window at a speed greater than the normal closing speed by the motor.

6 Claims, 8 Drawing Figures

DOOR AND WINDOW CLOSER

BACKGROUND OF THE INVENTION

Sliding doors and windows have come into wide usage in building construction in recent years. The use of air-conditioning and its high energy cost have made it increasingly important to keep doors and windows closed. In public buildings or in homes where children are present, it is difficult to enforce door and window closing rules.

Because of the stated need, several patents have disclosed various spring and gravity motors for automatically closing sliding windows and doors immediately after they have been opened. While some of these motors have been designed to close slowly and evenly, none of them have been able to cope with the situation in which a person forces the door closed at a rate in excess of the normal closing rate of the motor. Such forceful closing of the door has resulted in damage to the motor or malfunctioning of the entire mechanism.

SUMMARY OF THE INVENTION

The door and window closer of the present invention is a mechanism for closing sliding or swinging doors or windows which provides the closing force and controls the rate of travel toward the closed position. The purpose of the control is twofold. First, to prevent the door or window from traveling too fast and, second, to prevent the pulling cable from going slack should the door or window be pushed into the closed position faster than the closer's self-regulating rate of travel. The closer's source of closing force is either a spring or a gravity pulled weight. The spring version can be mounted with any orientation but the gravity version, of course, must be mounted with the long axis vertical. Both versions can be mounted in or on the wall adjacent to the door or window jamb against which the door or window closes or on the moving door or window. The closer's source of regulating force is derived from pneumatically compressed air, whose release is controlled by the closer's regulating valve and metering orifice. The metering orifice regulates the self closing rate but the regulating valve opens to release the air faster when the tension in the pulling cable is reduced by some external closing force such as a person pushing the door or window shut. The benefit of this self-regulation is to prevent slack from forming in the cable and still provide an immediate return to the normal closing rate upon removal of the external closing force. The problems of either a slack cable jumping off the pulleys or a shock induced high cable stress are eliminated. The smooth and consistent operation of the closer is therefore maintained independently of and without regard to external forces. In the spring operated version, the pulling cable passes over an internal pulley system to shorten the closer's internal stroke to approximately one fourth of the door or window travel. The gravity operated version can be made with or without an internal pulley system. Where sufficient installation height is available, no internal pulley system is used.

An added benefit of the present invention is the fact that by attaching the motor on the movable panel, the panel can not be lifted out of its track and security to the building is thereby enhanced.

A further object of the invention is to provide a closer which is relatively inexpensive, durable, and will operate with very little maintenance over a long period of time and will permit forced closings at almost any reasonable speed in excess of the normal motor rate.

DETAILED DESCRIPTION OF THE PREFERRED EMBODIMENTS OF THE INVENTION

Figures 3, 4, 5:
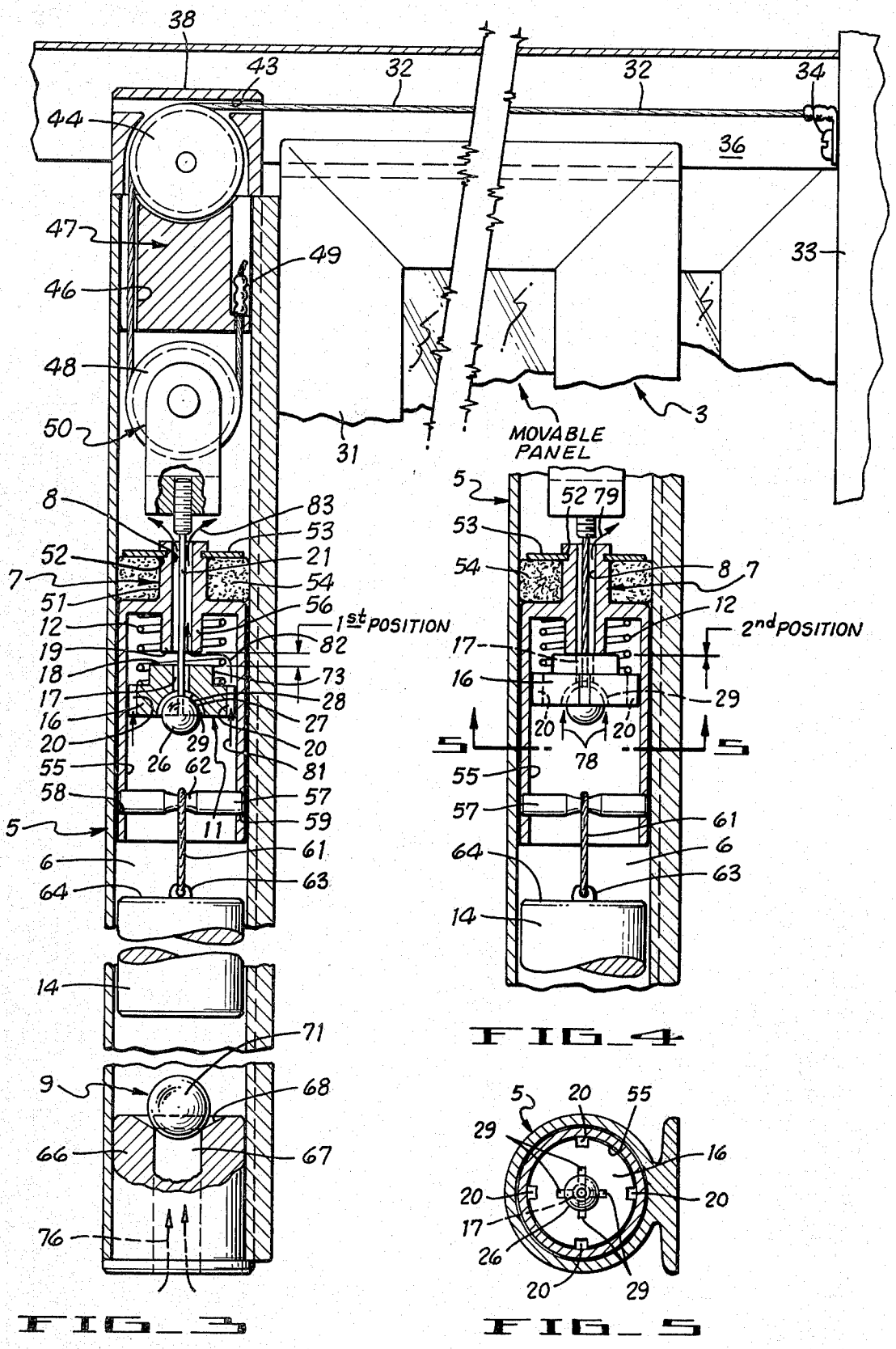
FIG. 3 is a cross section of a gravity motor shown in FIG. 1 and taken generally along the line 3—3. The weight for the motor is shown in the position that it would assume with the door or window open. The override valve is shown in the position that it would assume when the door is being closed more rapidly than the rate of closing by the gravity motor.
FIG. 4 is a cross section of the device constructed in accordance with the present invention as shown in FIG. 3 except that the override valve is in the position that is assumes during normal speed closer of the door or window by the gravity motor.
FIG. 5 is a cross sectional view of a portion of the device taken generally along lines 5—5 of FIG. 4.

Referring to FIG. 3 the closer apparatus of the present invention for a movable panel 3 having a first closed position covering a portion of an opening 2 surrounded by a frame 1 and a second position uncovering a portion of the opening; motor means 4 connected to the frame and movable panel and biasing the movable panel to the first closed position; a pneumatic cylinder 5 forming a compression chamber 6; a piston 7 formed with a passage 8 therethrough and mounted for slidable movement with the cylinder and operatively connected to the movable panel; check valve means 9 permitting the inlet of air to the cylinder upon movement of said panel from the first closed position to the second open position and blocking passage of air upon movement of the panel to the closed first position; air restriction means regulating the escape of compressed fluid from the chamber; an override valve means 11 mounted on the piston having a first position out of sealing contact with the fluid passage through the piston permitting flow of fluid therethrough from the chamber when the panel is forced to close at a rate faster than the normal closing of the panel by the motor means and a second position in substantial sealing engagement with the fluid passage in the piston; means 12 biasing the override valve means to the first open position; force means normally overcoming the biasing means during movement of the panel from the second to the first position thereby forcing the override valve means to the second position in substantial sealing engagement with the piston passage.

In the form of the invention shown in FIG. 3; the motor means includes a weight 14 slidably mounted in said cylinder for substantially vertical reciprocating travel and connected to said piston for travel therewith; the override valve means includes a valve plate 16 having a valve seat 18 at one end formed for sealably mating with a valve seat 19 on said piston; the valve plate 16 is formed with openings 20 which are in communication with the compression chamber and the passage 8 through the piston in the first position of the override valve means and out of communication with the passage through the piston in the second position of the override valve means; and the motor means includes a connection cable 21 operably connected at one end to the frame and has a connection member 26 on the other end operably connected to the piston.

In one form of the invention, the air restriction means for regulating the closing of the movable panel includes an opening 17 in the valve plate which is in communication with the compression chamber 6 and the passage 8 in the piston.

As shown in FIG. 3, the connection cable 21 is inserted through the passage 8 in the piston and the opening 17 in the valve plate.

The regulation of air pressure in compression chamber 6 may be accomplished in several ways. In one form of the invention the connection member 26 is connected to the end of the connection cable 21 and is formed with a hemispherical surface 27. The valve seat of the valve plate is formed with a registering hemispherical surface 28 including a plurality of shallow depressions 29 forming small passages communicating between the compression chamber 6 and the opening 17 in the valve plate.

Installation of the gravity motor is most easily accomplished by attaching the cylinder 5 to the edge of vertical member 31 of the movable panel. The attachment cable 32 may be anchored to the door jamb 33 by an anchor such as fastener 34. The attachment cable may be run in the upper track 36 above the horizontal channel member 37 to the upper plug 38 of the cylinder.

Figure 2:
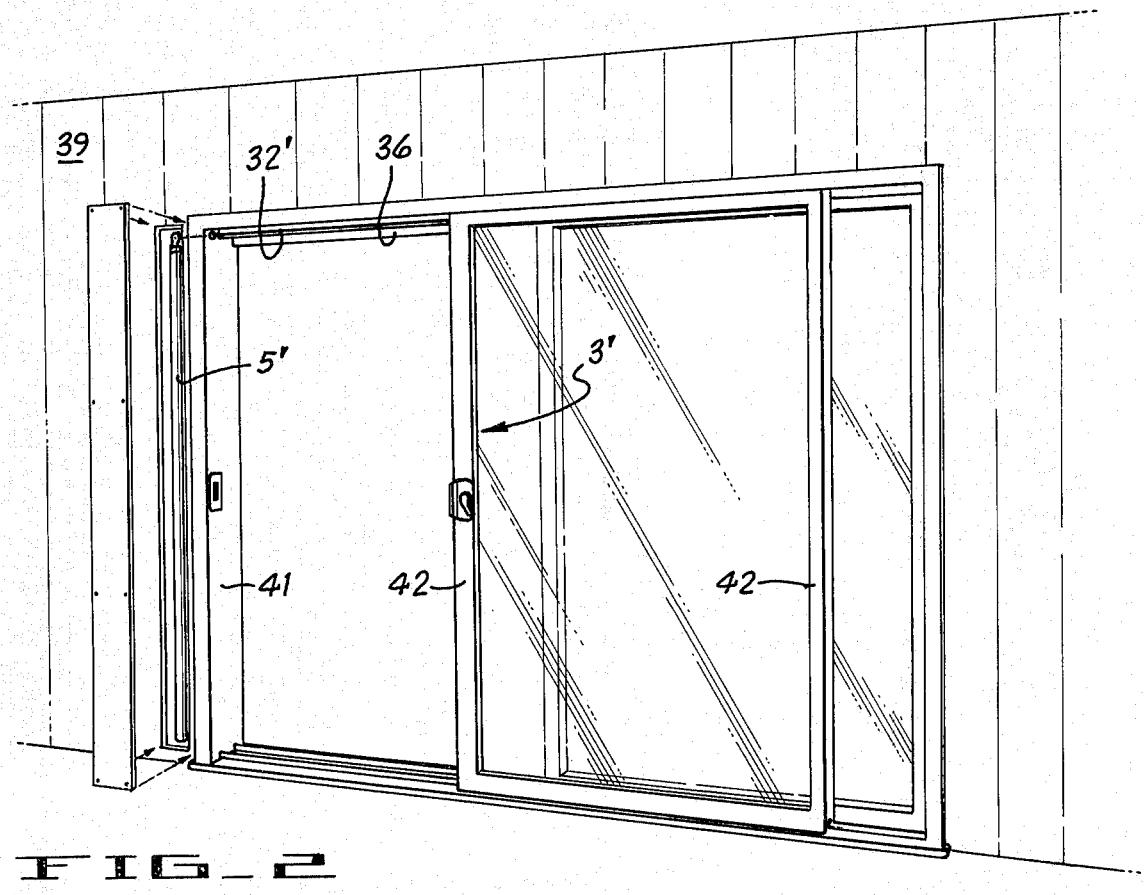
FIG. 2 is a perspective view of an alternate form of the invention in which the motor is installed within the wall behind the door jam.

Another type of installation for the gravity motor is shown in FIG. 2 in which the cylinder 5′ is mounted in the wall 39 behind the door jamb 41. An access plate should be provided for maintenance and replacement. The attachment cable 32′ may be attached to the vertical member 42 on the movable panel 3′ by a suitable fastener.

The motor means is preferably constructed so that a maximum amount of cable is stored within the cylinder in a minimum portion of the cylinder. Preferably the attachment cable enters the cylinder through a small opening 43 in the upper plug 38 which services to guide the attachment cable onto a rotatably mounted sheave 44. Elongated slots 46 guide the cable through the guide block 47 to movable sheave 48 on movable pulley assembly 50. As previously discussed, movable sheave 48 is suitably attached to cable 21 which is operably attached to piston 7. The attachment cable 32 is carried around movable sheave 48 mounted on movable pulley assembly 50 and is attached to the guide block at attachment 49.

Piston 7 may be constructed in various forms, one of which is illustrated in FIG. 3. As shown in the drawing, an upper stem 51 carries an annular groove 52 which holds retainer washer 53 which in turn retains the packing material 54 which forms the airtight seal between the piston 7 and the walls of the cylinder 5. Connected to the stem is the main body 55 which consists of an annular sleeve which contains the override valve means 11. The stem 51 may be elongated to form a protrusion 56 which serves to retain spring 12. At the lower end of the main piston body a pin 57 is inserted through pin openings 58 and 59 in the piston. Weight 14 is attached to the pin 57 by any suitable means such as cable 61. Necking the center of the pin as at 62 serves to center the cable. Preferably the cable 61 consists of a short loop of cable spot welded on its ends 63 to the top face 64 of weight 14.

The check valve means 9 may be provided by various mechanisms. One form of check valve means is illustrated and consists of an end plug 66 formed with a passage 67 through the plug terminating in a hemispherical depression 68 which receives a spherical ball 71. The spring 12 which serves as the biasing means between the piston and the override valve means is retained on the valve plate 16 by forming a shoulder 73 on one end.

OPERATION OF THE CLOSER WITH A GRAVITY MOTOR a. Opening mode

Figure 1:
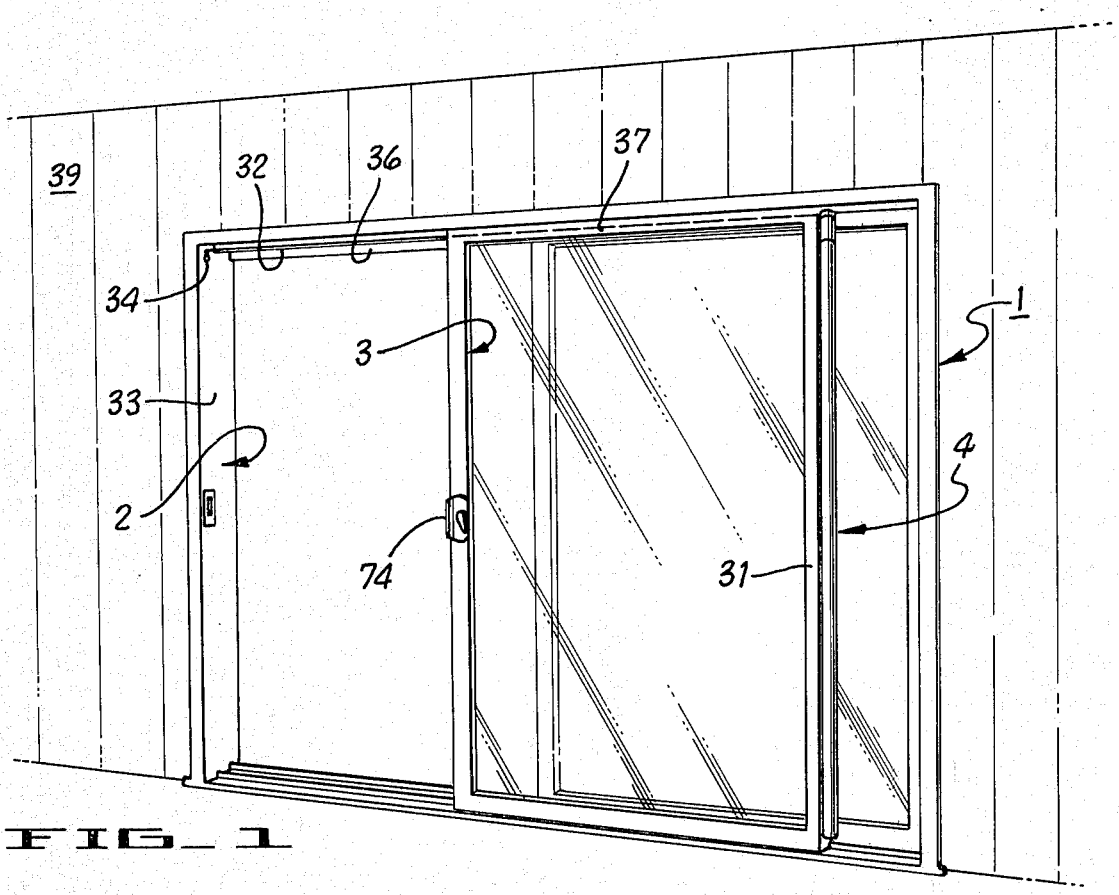
FIG. 1 is a perspective drawing of a door opening having a movable panel and an immovable panel. In this illustration, the motor is attached to the movable panel.

Referring to FIGS. 1, 3 and 4 the operation of the device of the closer using a gravity motor is as follows: When a person enters opening 2, he grasps the handle 74 of the movable panel 3 and moves the panel to the right as shown in FIG. 1. Movement of the door causes the cylinder 5 to move to the right thus causing attachment cable 32 to be drawn out of the cylinder. As the attachment cable is drawn out of the cylinder through opening 43, movable pulley assembly 50 is raised. Force is exerted on connection cable 21. Connection member 26 is forced against valve plate 16 thereby seating the valve plate against the valve seat 19 on piston 7. Spring 12 is compressed and the flow of air through passages 20 in the override valve plate 16 is cut off from passage 8 in the piston 7. As piston 7 rises, a vacuum is created in the compression chamber 6 which causes air to enter as shown by arrow 76 through passage 67 in the end plug 66 forcing ball 71 off its seat 68. Air also enters compression chamber 6 via passage 8 in the piston, opening 17 in the valve plate 16 and shallow depressions 29 in the valve plate.

b. Closing mode

The movable panel 3 is automatically closed by the gravity motor when the person opening the panel releases the movable panel. FIG. 4 illustrates the positions assumed by the override mechanism when the door is closed at normal speed and under the influence only of the gravity motor.

Weight 14 pulls on cable 61 which in turn exerts a downward force on the main body 55 of piston 7. As piston 7 moves downwardly it compresses spring 12 and protrusion 56 moves downwardly until valve seat 19 moves against valve seat 18 of the valve plate. The valve plate moves downwardly engaging connection member 26 which places connection cable 21 in tension. The connection cable pulls downwardly on movable pulley 50 which causes attachment cable 32 to be drawn into the cylinder 5. Ball check valve means 9 automatically closes and the air in compression chamber 6 can only leave the chamber via shallow depressions 29, opening 17 in the valve plate 16 and passage 8 in piston 7 as shown by entry arrows 78 and exit arrows 79. This metering of the air from the compression chamber causes the movable panel to close slowly and evenly. Note that the closure of the movable panel can be checked at any point without damage to the mechanism and the movable panel can be opened again at any point in the closure cycle.

c. Forced closing

When the movable member is forced toward the closed position at a faster rate than the normal closing rate exerted by the gravity motor, the mechanism assumes the position as shown in FIG. 3. Thus when a person grasps door handle 74 and moves the panel swiftly to the left, tension from attachment cable 32 is removed and unless the gravity motor is "speeded up" the cable would go slack thus resulting in the cable 32 possibly jumping off the sheave 38. When this external force occurs, and the upward force exerted by cable 32 on movable pulley 50 is reduced, compression spring 12 forces valve plate 16 away from valve seat 19 on piston 7. Air is now free to escape from compression chamber 6 via openings 20 through the valve plate and passage 8 through piston 7. The flow of air in FIG. 3 is shown by arrows 81, 82 and 83.

Figures 6, 7, 8:
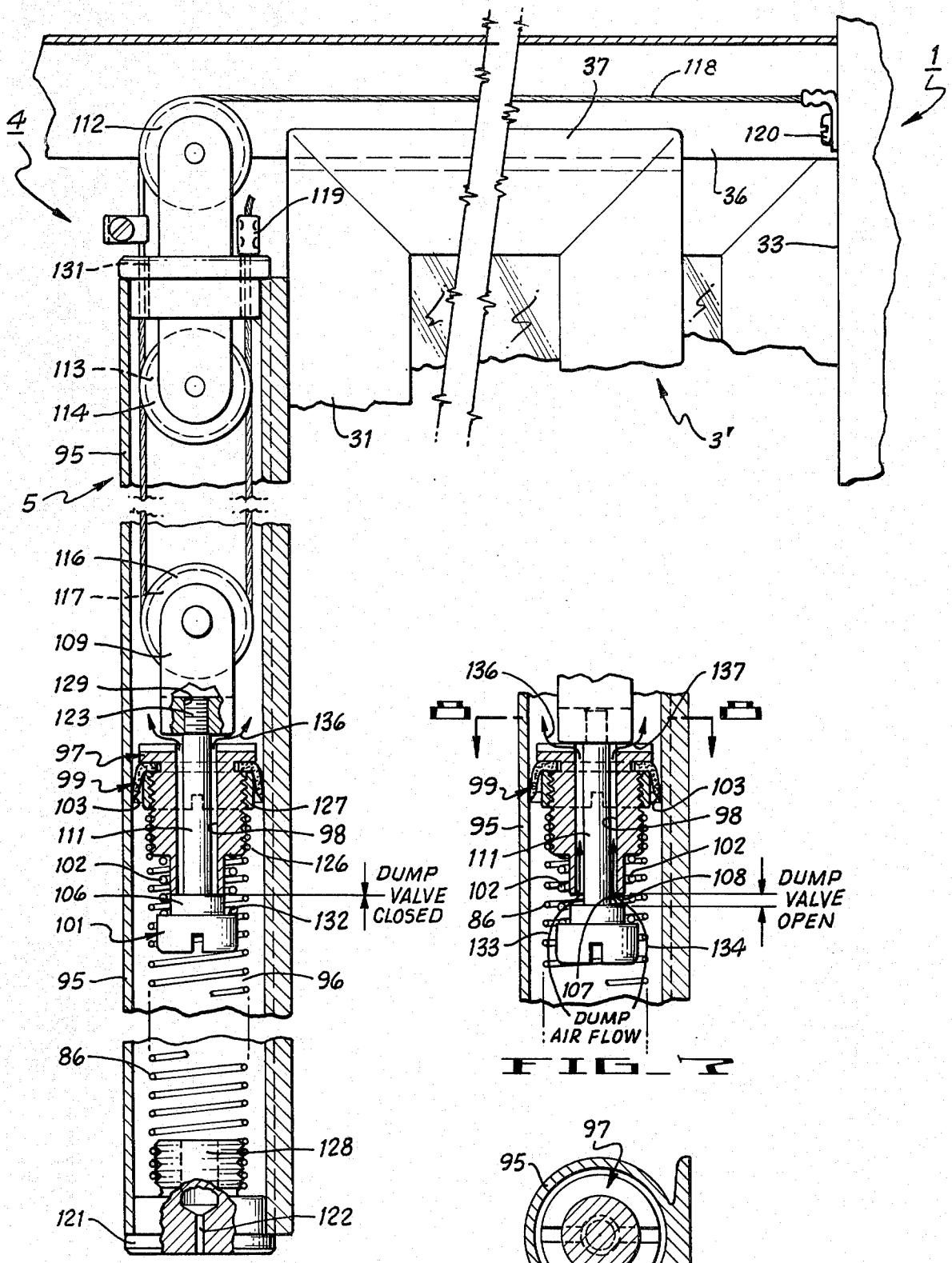
FIG. 6 is a cross section of an alternate form of the invention showing a spring motor. The override valve is in the position it would assume during normal closing of the door or window.
FIG. 7 is a partial cross section of the device shown in FIG. 6. The override valve is in the position it would assume during the closing of the door at a speed faster than the normal rate by the spring motor.
FIG. 8 is a cross section of the invention shown in FIG. 7 taken generally along the line 8—8.

An alternate form of the invention is shown in FIGS. 6–8 in which the motor means includes a spring 86 in place of the weight 14 used in the device shown in FIGS. 3–5.

The closer apparatus with a spring motor means consists briefly of a pneumatic cylinder 95 forming a compression chamber 96; a piston 97 formed with a passage 98 therethrough and mounted for slidable movement within the cylinder and operatively connected to the movable panel for compressing air within the chamber; check valve means 99 permits the inlet of air to the compression chamber of the cylinder upon movement of the panel from the first closed position to the second open position and blocks passage of air upon movement of the panel to the closed first position; air restriction means regulates the escape of compressed fluid from the chamber; an override valve means 101 mounted on the piston has a first position out of sealing contact with the fluid passage through the piston permitting flow of fluid therethrough from the chamber when the panel is forced to close at a rate faster than the normal closing of the panel by the motor means and a second position in substantial sealing engagement with the fluid passage in the piston; means 102 biasing the override valve means to the first open position; and means normally overcoming the baising means during movement of the panel from the second to the first position thereby forcing the override valve means to the second position in substantial sealing engagement with the piston passage.

The check valve means includes an annular piston cup seal 103 mounted on the piston 97.

The override valve means includes a valve head 106 and a valve seat 107 movable into sealing engagement with a valve seat 108 communicating with passage 98. The valve head 106 is connected to movable pulley assembly 109 by a shaft 111 having a cross section less than the valve passage 98 through which the shaft is inserted.

The motor means includes an external pulley 112 mounted on the outside of the cylinder, a pair of stationary pulleys 113 and 114 mounted on the inside of the cylinder, a pair of movable pulleys 116 and 117; a cable 118 operatively connecting the movable panel and the frame; and the cable passes over the external pulley 112, over one of the stationary paired pulleys 113, over and around a first movable pulley 116, back to and over the other of the paired pulleys 114, back again to and over the second of the movable pulleys 117 and then past the paired stationary pulleys to a connection 119 on the cylinder.

Installation of the spring motor may be on the back edge of vertical member 31 as shown in FIG. 1 or behind the wall as shown in FIG. 2. Another possible location is above the door or window opening in either a horizontal or slanted position. The end of the cable may be connected to the frame by fastener 120.

The air restriction means for regulating the escape of compressed fluid from the chamber may be constructed in various ways. As shown in FIG. 6, a plug 121 is inserted into the end of the cylinder 95. A small passage 122 is formed in the end plug 121.

Piston 97 is preferably constructed with external threads 126 for threadably receiving several turns of spring 86 and for receiving internally threaded nut 127 which holds piston cup 103. The other end of spring 86 is threadably attached to an externally threaded member which may be formed as a part of end plug 122.

Shaft 111 is threaded at one end 123 and is threadably connected to internal threads of bore 129 in movable pulley 109.

OPERATION OF THE CLOSER WITH A SPRING MOTOR a. Opening Mode

Referring to FIGS. 6 and 7 the operation of the closing device using a spring motor is as follows: When a person enters opening 2, he grasps the handle 74 of the movable panel 3 and moves the panel to the right as shown in FIG. 1. Movement of the door causes the cylinder 95 to move to the right causing attachment cable 118 to be drawn out of the cylinder. As the attachment cable is drawn out of the cylinder through opening 131, movable pulley assembly 109 moves toward the nose end of the cylinder (upwardly as shown in FIG. 6) and pulls shaft 111 with it. The override valve is closed as shown in FIG. 6 and valve seat 107 if forced against valve seat 108 and valve 97 elongates spring motor 86 placing the spring in tension. As the valve 97 moves toward the nose end, air enters the pressure chamber 96 through regulator opening 122, but most of the air enters past annular piston cup seal 103. Spring 102 remains compressed at all times during opening of the movable panel.

b. Closing Mode

When the handle of the movable panel is released, the spring 86 exerts a pulling force on the valve 97 which in turn pulls movable pulley assembly 109 downwardly as shown in FIG. 6. Cable 118 is drawn into the cylinder. The closing speed of the movable panel is regulated by the rate at which the compressed air can be expelled through passage 122 in end plug 121. Note that the annular piston cup seal 103 acts as a check valve and prevents air from escaping from the compression chamber 96 during the closing mode.

c. Forced Closing Mode

In the event that a person attempts to close the movable panel at a speed in excess of the normal closing rate of the door or window, the override mechanism goes into operation in the following manner. When tension is released from cable 118, spring 102 which is in compression exerts a force on override valve head 106 at shoulder 132. As override valve 101 opens, compressed air moves from compression chamber 96 between valve seats 107 and 108 as shown by arrows 133 and 134. The air moves along passage 98 and exits from the piston as shown by arrows 136 and 137. When the reduced air pressure in pressure chamber 96, spring 86 is able to move the piston quickly toward end plug 121 thereby taking up cable 118 before any slack can occur. As soon as the external force is released on the handle, the spring 86 overcomes spring 102 and closes override valve 101. The regulated closing speed of the door again takes place under the action of spring 86.

In an alternate form of the invention shown in FIG. 6, pulley 114 may be canted as to permit maximum sheave diameter within the enclosure by running the entering and leaving cable ends beside the sheave and to achieve optimum alignment for the cable coming from and returning to the paired sheaves on the double block. In the door closed position, the maximum amount of cable is inside the housing, the tension spring is at minimum extension, the valve spring is at maximum compression and the valve shaft is seated.

We claim:

1. A closer apparatus for a movable panel having a first closed position covering a portion of a framed opening and a second open position uncovering a portion of said opening comprising:

a. motor means connected to said frame and movable panel and biasing said movable panel to said first closed position; and said motor means includes a weight mounted for substantially vertical reciprocating travel and connected to said piston for travel therewith;

b. a pneumatic cylinder forming a compression chamber;

c. a piston formed with a passage therethrough and mounted for slidable movement within said cylinder and operatively connected to said movable panel for compressing air within said chamber;

d. check valve means permitting the inlet of air to said compression chamber of said cylinder upon movement of said panel from said first closed position to said second open position and blocking passage of air upon movement of said panel to said closed first position;

e. air restriction means regulating the escape of compressed fluid from said chamber;

f. an override valve means mounted on said piston having a first position out of sealing contact with said fluid passage through said piston permitting flow of fluid therethrough from said chamber when said panel is forced to close at a rate faster than the normal closing of said panel by said motor means and a second position in substantial sealing engagement with said fluid passage in said piston and said override valve means includes a valve plate having a valve seat at one end formed for sealably mating with a valve seat on said piston;

g. means biasing said override valve means to said first open position;

h. force means normally overcoming said biasing means during movement of said panel from said second to said first position thereby forcing said override valve means to said second position in substantial sealing engagement with said piston passage;

i. said valve plate is formed with openings which are in communication with said compression chamber and said passage through said piston in said first position of said override valve means and out of communication with said passage through said piston in said second position of said override valve means; and j. said motor means includes a connection cable operably connected at one end to said frame and has a connection member on the other end operably connected to said piston.

2. A closer as described in claim 1 comprising:

a. said air restriction means for regulating the closing of said movable panel includes an opening in said valve plate in communication with said compressing chamber and said passage in said piston.

3. A closer as described in claim 2 comprising:

a. said connection cable is inserted through said passage in said piston and said opening in said valve plate.

4. A closer as described in claim 3 comprising:

a. said connection connected to the end of the connection cable is formed with a hemispherical surface and said valve seat of said valve plate is formed with a registering hemispherical surface including a plurality of shallow depressions forming small passages communicating between said compression chamber and said opening in said valve plate.

5. A closer apparatus for a movable panel having a first closed position covering a portion of a framed opening and a second open position uncovering a portion of said opening comprising:

a. motor means connected to said frame and movable panel and biasing said movable panel to said first closed position;

b. a pneumatic cylinder forming a compression chamber;

c. a piston formed with a passage therethrough and mounted for slidable movement within said cylinder and operatively connected to said movable panel for compressing air within said chamber;

d. check valve means permitting the inlet of air to said compression chamber of said cylinder upon movement of said panel from said first closed position to said second open position and blocking passage of air upon movement of said panel to said closed first position;

e. air restriction means regulating the escape of compressed fluid from said chamber;

f. an override valve means mounted on said piston having a first position out of sealing contact with said fluid passage through said piston permitting flow of fluid therethrough from said chamber when said panel is forced to close at a rate faster than the normal closing of said panel by said motor means and a second position in substantial sealing engagement with said fluid passage in said piston;

g. means biasing said override valve means to said first open position;

h. force means normally overcoming said biasing means during movement of said panel from said second to said first position thereby forcing said override valve means to said second position in substantial sealing engagement with said piston passage;

i. said motor means includes a spring mounted in said cylinder connected at one end to said cylinder and at its other end to said piston;

j. said check valve means includes an annular piston cup seal mounted on said piston; and k. said override valve means includes a shaft and a valve head connected to one end of a movable pulley and said valve head is movable into sealing engagement with said passage through said piston and said shaft has a cross section less than said valve passage through which said shaft is inserted.

6. A closer as described in claim 5 comprising:

a. said motor means includes an external pulley mounted on the outside of said cylinder, a pair of stationary pulleys mounted on the inside of said cylinder, a pair of movable pulleys mounted on the inside of said cylinder and connected to said shaft;

b. said motor means includes a cable operatively connecting said movable panel and said frame; and c. said cable passes over said external pulley, over one of said stationary paired pulleys, over and around a first movable pulley back to and over the other of said paired pulleys, back again to and over the second of said movable pulleys and then past said paired stationary pulleys to a connection on said cylinder.

* * * * *